US012185885B2

(12) United States Patent
Brewer

(10) Patent No.: US 12,185,885 B2
(45) Date of Patent: Jan. 7, 2025

(54) DEVICE AND METHOD FOR CLEANING BUTTOCK CREASE

(71) Applicant: Jared P Brewer, Thornton, CO (US)

(72) Inventor: Jared P Brewer, Thornton, CO (US)

( * ) Notice: Subject to any disclaimer, the term of this patent is extended or adjusted under 35 U.S.C. 154(b) by 310 days.

(21) Appl. No.: 17/686,004

(22) Filed: Mar. 3, 2022

(65) Prior Publication Data

US 2022/0338683 A1 Oct. 27, 2022

Related U.S. Application Data

(60) Provisional application No. 63/179,786, filed on Apr. 26, 2021.

(51) Int. Cl.
*A47K 7/08* (2006.01)

(52) U.S. Cl.
CPC ..... *A47K 7/08* (2013.01)

(58) Field of Classification Search
CPC ..... A47K 7/08; A47K 7/02; A47K 7/022
USPC ..... 15/210.1
See application file for complete search history.

(56) References Cited

U.S. PATENT DOCUMENTS 3,812,849 A * 5/1974 Giunta ..... A47K 7/022 601/154
4,343,061 A * 8/1982 Hanazono ..... A47K 7/02 15/210.1
5,465,452 A 11/1995 Girardot
5,491,864 A 2/1996 Tuthill
5,555,591 A 9/1996 Chang
6,047,433 A 4/2000 Chang
6,098,236 A * 8/2000 Chen ..... A47K 7/022 15/209.1
6,165,603 A * 12/2000 Girardot ..... A47K 7/02 15/208
6,227,742 B1 5/2001 Corn
8,141,196 B2 3/2012 Chen
9,561,137 B2 2/2017 Melki
2009/0144878 A1 6/2009 Mina
2009/0193605 A1 8/2009 D'Angelo
2009/0255080 A1 10/2009 Lozinik
2010/0192318 A1 8/2010 Huizinga
2015/0216741 A1 8/2015 Burgess
2017/0354233 A1 12/2017 Neilsen

FOREIGN PATENT DOCUMENTS

EP 619974 A1 10/1994
WO WO9913759 A1 3/1999
WO WO-2007001955 A2 * 1/2007 ..... A47K 7/08

* cited by examiner

*Primary Examiner* — Tom Rodgers
(74) *Attorney, Agent, or Firm* — Leyendecker & Lemire, LLC

(57) ABSTRACT

A personal hygiene device for cleaning a crease of a buttock, essentially comprising an elongated flexible plastic tubular netting that is folded over onto itself one or more times and has a plurality of knots tied along a center portion of its folded length is described. The device includes ends intended to be held in the hands of a user during use when the device is slid back and forth in the crease to clean it.

5 Claims, 6 Drawing Sheets

DEVICE AND METHOD FOR CLEANING BUTTOCK CREASE

BACKGROUND

Keeping the crease formed between the left and right gluteus maximus muscles and, more particularly, the surface surrounding the anus clean is desirable for reasons of both health and comfort. Typically, people wipe this region of the body on an as needed basis using toilet paper, but this process does not utilize water and/or soap and may not be as effective as desirable or necessary. People often wipe around this region with a wash cloth while showering but may avoid penetrating into the crease for fear of contaminating or soiling the wash cloth, which is to be used on other regions of the body thereafter. People with removable shower heads may spray a stream of water into the region hoping to fully clean it, but water alone without soap and scrubbing action is not very effective.

A BRIEF DESCRIPTION OF THE DRAWINGS

DETAILED DESCRIPTION

Figure 1:
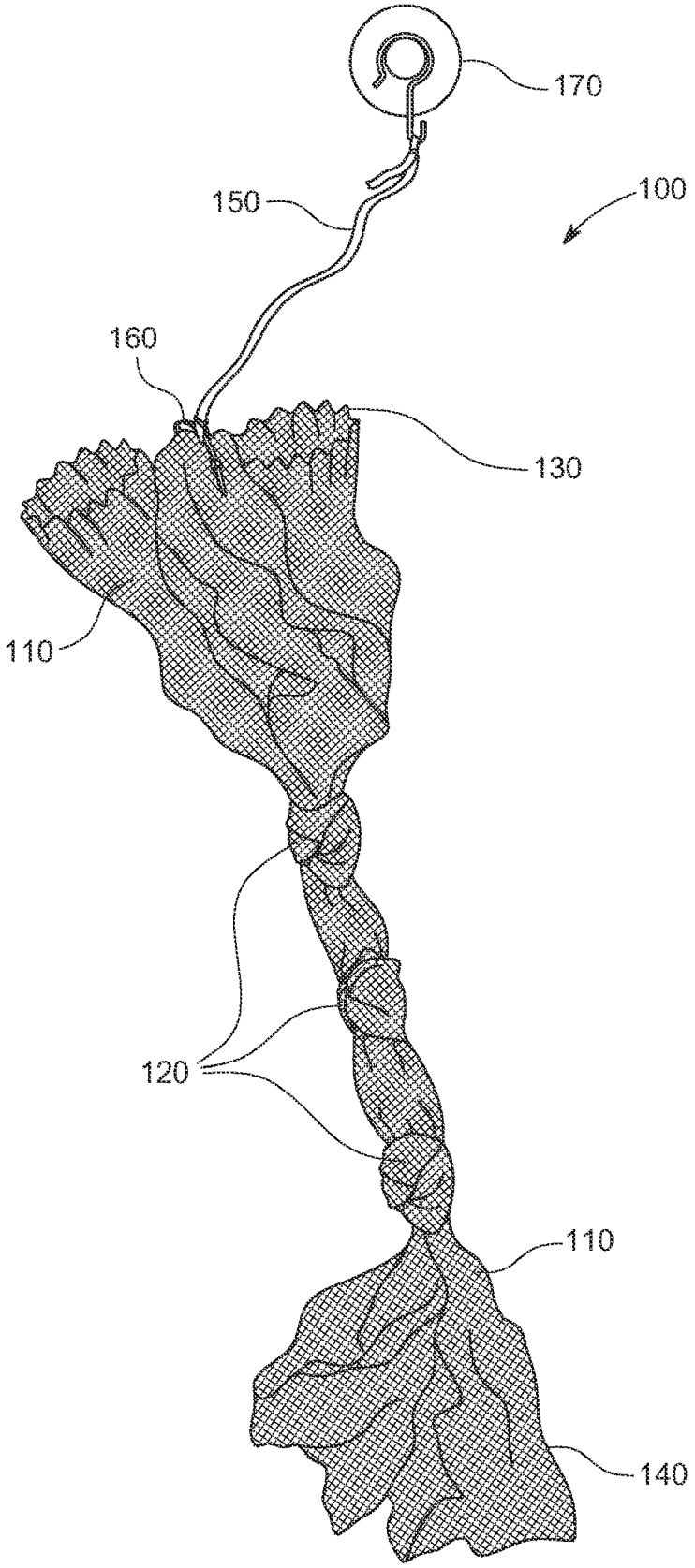
FIG. 1 is an isometric view of a personal hygiene device accordingly to one embodiment of the present invention.

Embodiments of the present invention, personal hygiene devices for cleaning the crease of a buttock, essentially comprise elongated flexible plastic tubular netting that are folded over onto themselves one or more times and each have a plurality of knots tied along its folded length generally proximate and spaced outwardly from its center. These devices each include ends intended to be held in the hands of a user during use when the device is passed between the user's legs.

In some embodiments of the device, a strap, ribbon, rope or other connector, such as a zip tie, may be attached to an end of the device to permit the device to be hung or otherwise stored in a shower or bath stall. In some variations the strap maybe configured in a loop to be hung over a handle or hook. In other variations the strap may have a hook or suction cup attached to it so it can be secured to a tiled or glass shower wall or door.

Other embodiments describe a method of using a personal hygiene device to clean the crease of a buttock of the user. The method includes the user passing the device between his/her legs, holding each end of the device in a hand, and sliding or moving a center portion of the device to and fro against the user's buttock crease. Variations of the method further include placing soap on the device and rinsing the device after usage.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

Embodiments of a Personal Hygiene Device

FIG. 1 is an illustration of an embodiment of a personal hygiene device 100 configured for use in effectively cleaning a person's buttock crease. The device is comprised of a flexible plastic tubular netting 110 that is folded over on to itself. The folded tubular netting has multiple knots 120 tied into it defining the center section that includes the knots and portions between the knots. The configuration of the device permits a user to pass it between his/her legs and move the device back and forth against the user's buttock crease while holding the ends portions 130 & 140 of the device.

Figure 5:
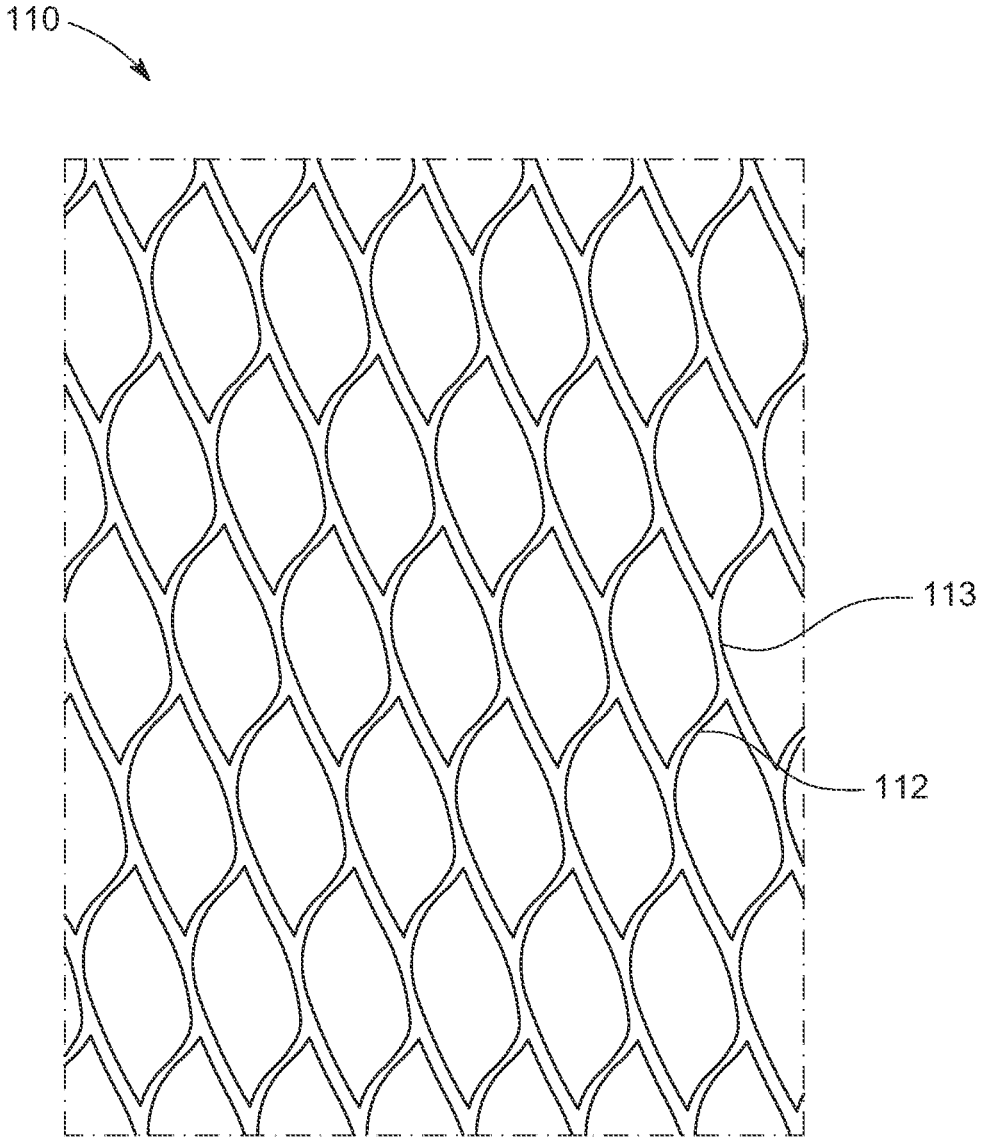
FIG. 5 is a close up view of the flexible plastic tubular netting material used in embodiments of the present invention.

The flexible plastic tubular netting 110 is commonly used in a variety of products including but not limited to: synthetic loofahs; packaging for products, such as produce; and protective coverings for products. The netting can be made of any suitable polymeric material and by a number of suitable manufacturing processes. One variation of tubular netting as shown in FIG. 5 is comprised of fine filaments 112 of a suitable thermoplastic, such as nylon, polypropylene or polyethylene. Other plastics may also be used to fabric the tubular nets including biodegradable hemp-based plastics. A typical diameter of a filament is between about 0.004" and 0.016". The filaments 112 are fused together (see element 113 of FIG. 5) during fabrication of the tubular net and form hexagonal cells that can expand and contract depending on how the material is pulled and stretched. Of note, the view in FIG. 5 is orientated with the such that the vertical direction as shown corresponds to the lengthwise direction in embodiments of the device 100. The tubular netting can have any desired unstretched diameter, but tubular netting most typically utilized has an unstretched diameter of about 3-5". Stretching the material radially outwardly can increase the diameter substantially and significantly just as stretching the material lengthwise can reduce the diameter substantially and significantly.

In variations the flexible plastic tubular netting can be fabricated from sheet material rather than filament wherein the sheet material is highly perforated to form netting. In other variations, strips of flexible netting may be used instead of netting in tubular form.

Figure 3:
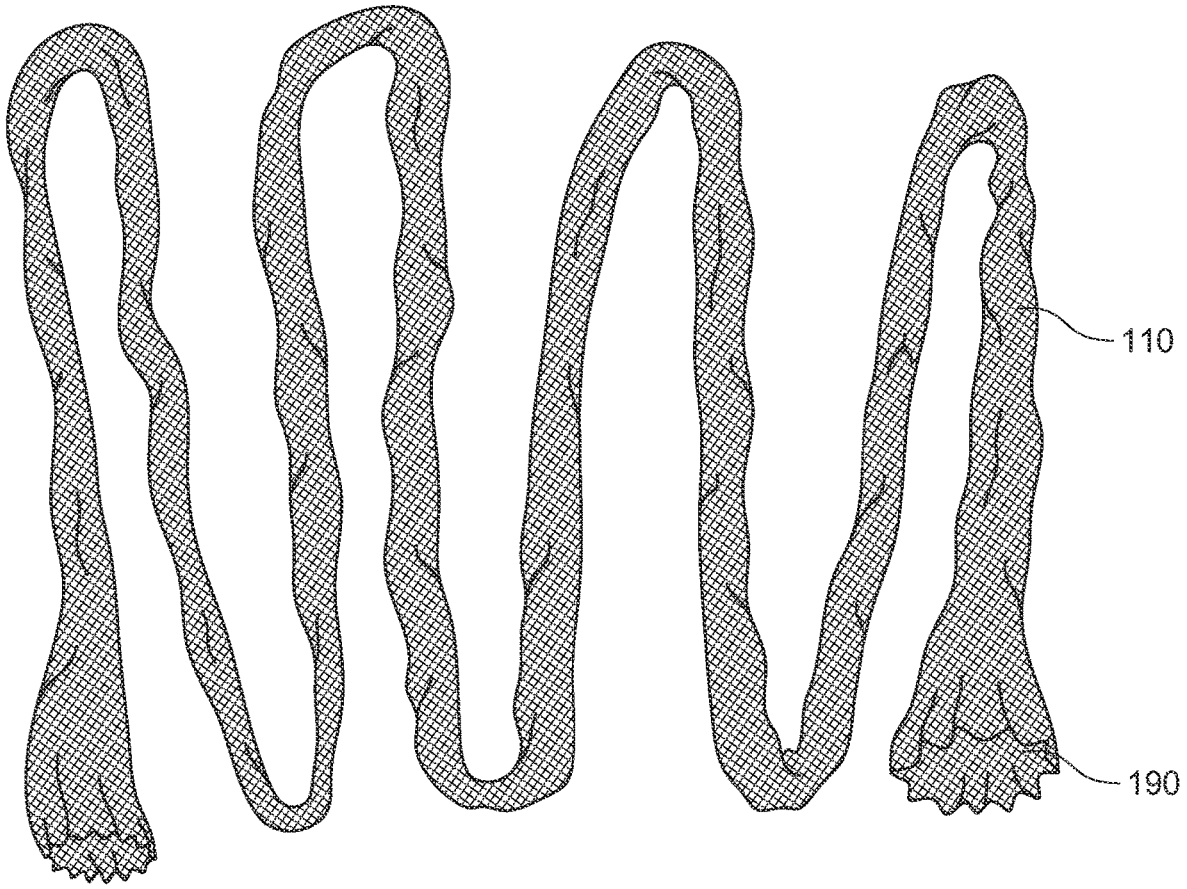
FIG. 3 is an isometric view of the flexible tubular netting prior to folding and knotting.

FIG. 3 is an illustration of flexible tubular netting 110 in an unfolded configuration prior to being formed into the personal hygiene device 100. As can be seen the ends of the netting form open tubular ends 190. As can be appreciated, the tubular netting is most typically provided on spools from which a desired length is cut and formed into the personal hygiene device. In one embodiment a length of about 150" inches of tubular netting is utilized to fabricate a typical personal hygiene device.

To create embodiments of the personal hygiene device, the tubular netting is folded onto itself one or more times to create a folded length of netting that comprises two or more runs of the tubular netting. For example, variations may be folded into halves, thirds, or fourths. In one variation, the tubular netting is folded onto itself twice into fourths.

Knots 120 are tied in the center region of the personal hygiene device 100 defining the center section. Three knots are typical but variations with as few as two, and as many as four or more are also contemplated. In a variation comprising about 150" of 4" diameter tubular netting folded into fourths, three knots are used creating a center section of about 8-10" in length from the outer longitudinal end of a first knot to the outer longitudinal end of a third knot with a second knot between spaced from the first and third knots and being generally centered therebetween. The maximum diameter of the knots tied as single knots is about 0.8" to 1.0". The overall length of this variation is about 32" with the length of the respective end portions 130 & 140 being about 10-12". The length of the end portions is typically long enough to permit a user to get a good grip on the device even when the device is lathered with soap. For instance, a user might wrap the end portions around one or more fingers to prevent slippage.

Figure 2:
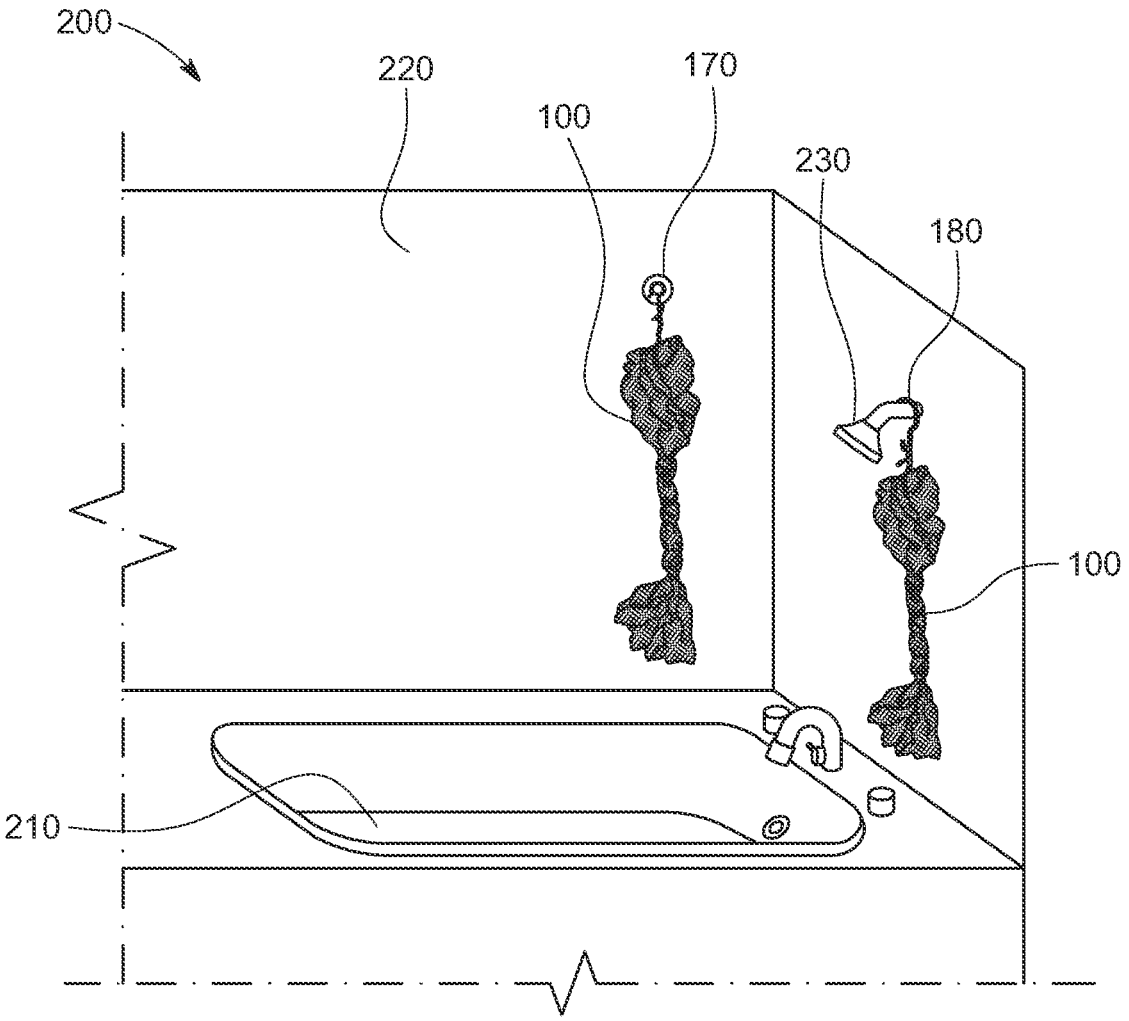
FIG. 2 is a isometric view of a personal hygiene device attached to the wall of a shower stall and another attached to the showerhead pipe according to one embodiment of the present invention.
Figure 4:
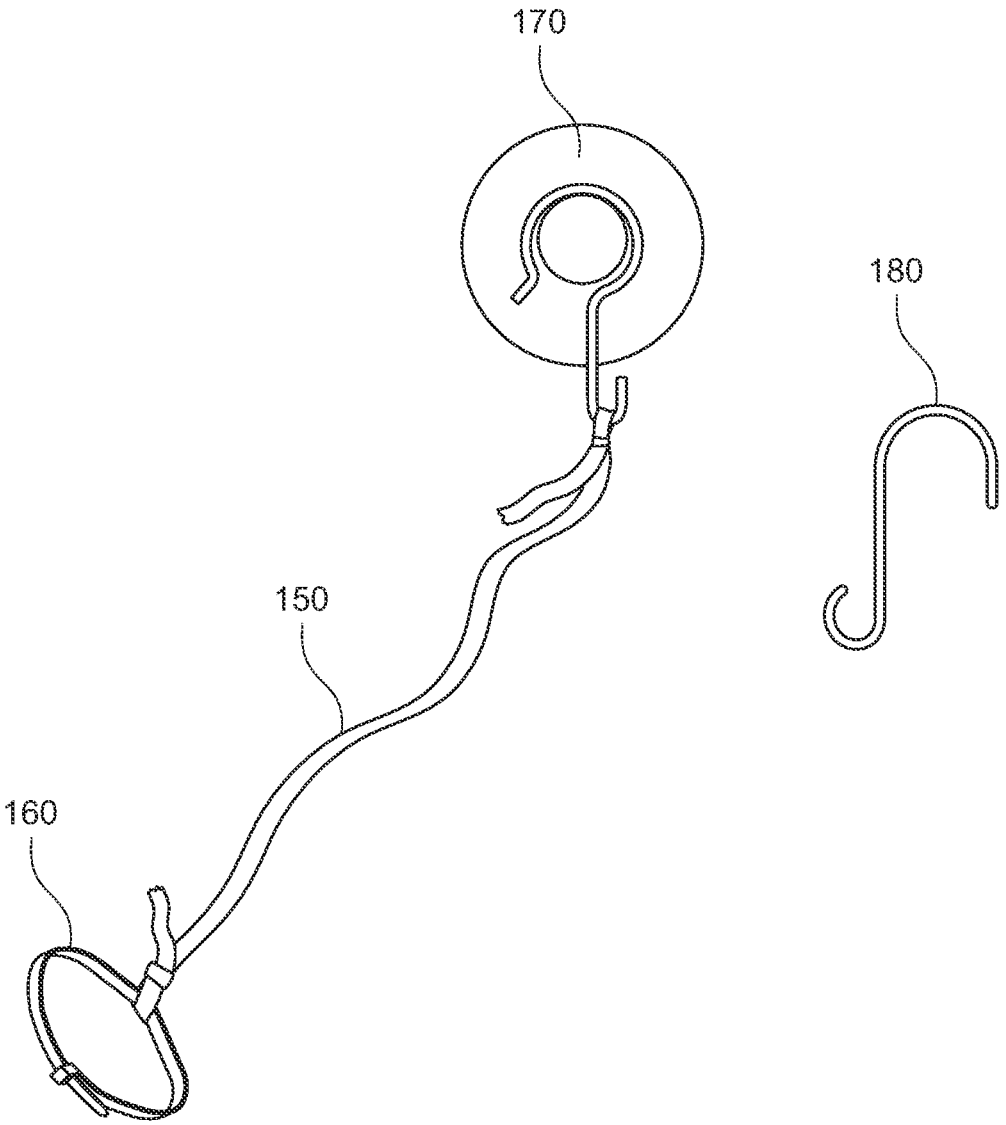
FIG. 4 is a view of a strap, zip ties, and suction cup or hook that can be used to secure the personal hygiene device to a wall or door in a shower or bathtub enclosure according to one embodiment of the present invention.

Some variations can include a flexible strap 150 (including ropes, chains, or ribbons) secured proximate one end 130, 140 of the device 100 to help facilitate storage of the device when not in use. In at least one variation, the strap is secured to the personal hygiene device by way of a zip tie 160. The strap can be looped at one end to permit the device to be hung from any suitable protrusion in a bathtub stall 200 or shower stall. Alternatively, the distal end of the strap can be tied or otherwise secured to a hook 180 or suction cup assembly 170 as shown in FIG. 4. The suction cup assembly can used to secure the device to a smooth, often tiled, wall 220 in a bathtub stall or shower stall as best seen in FIG. 2. FIG. 2 also shows a personal hygiene device hanging from the showerhead pipe by way of a hook. By hanging the device vertically, it can drain into an underlying tub 210 or shower pan to dry.

A Method of Using a Personal Hygiene Device

Figure 6:
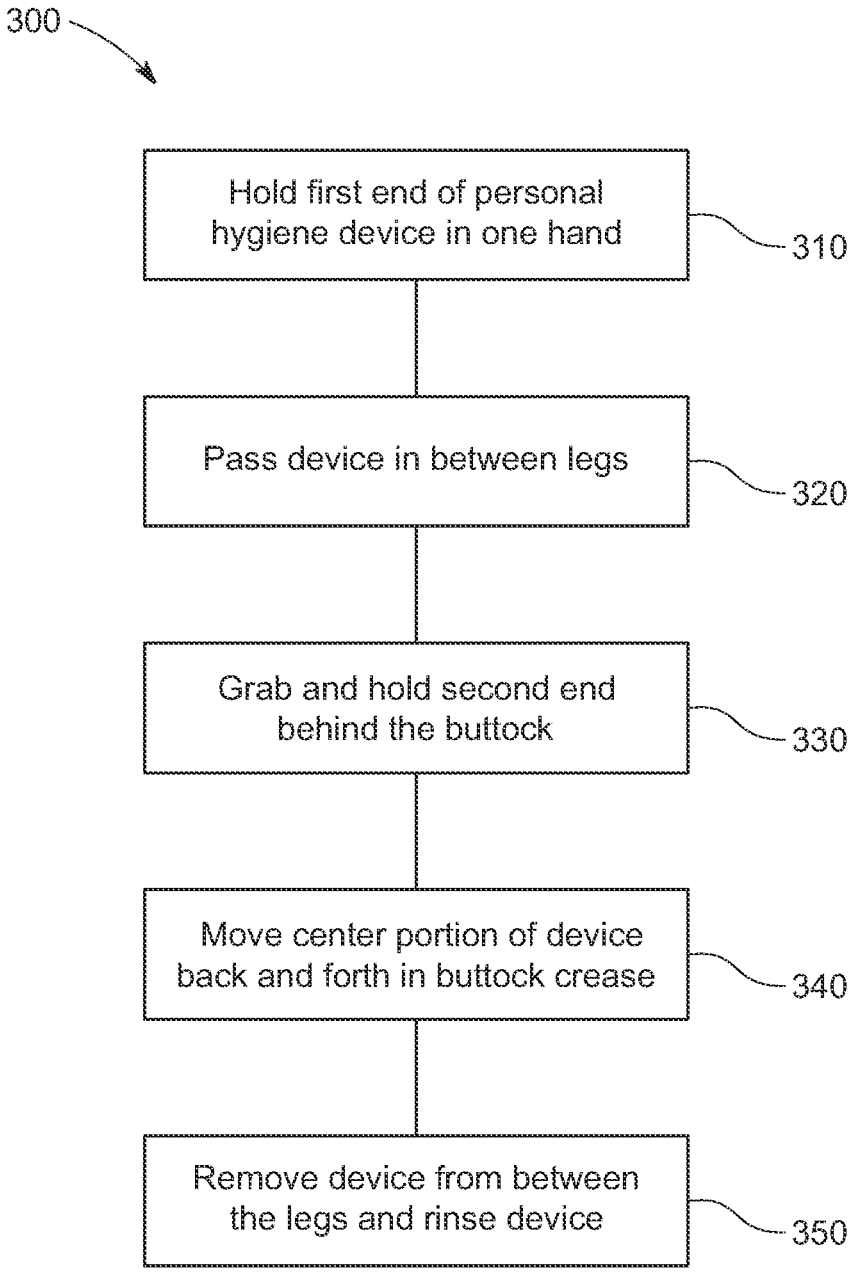
FIG. 6 is a flow chart pertaining to a method of using an embodiment of the personal hygiene device.

FIG. 6 is a flow chart 300 pertaining to the use of an embodiment of the personal hygiene device 100 to clean a user's buttock crease. Optionally, before using the device, a user may one or both of wet the device and apply soap to the device to enhance its cleaning abilities.

As indicated in box 310, the user grabs ahold of a first end 130 of the device 100 in one hand. Next, the user passes the second end 140 and center portion 115 of the device through his/her legs as indicated in box 320. The user grabs ahold of the second end with his/her other hand from behind his/her buttock as indicated in box 330. As The center portion of the device is then brought into contact with the user's buttock crease and moves the center portion back and forth within the crease as indicated in box 340. The knots and the netting structure of the device help scrub and clean the crease.

When the crease has been sufficiently cleaned the user lets go of one end and removes the device from his/her legs, and typically rinses the device as indicated in box 350. Thereafter, the device, if equipped with a strap 150 and hook 180 or suction cup 170, can be hung within the bathtub or shower stall to dry between uses.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of using a personal hygiene device, the method comprising:

providing a reusable personal hygiene device, the personal hygiene device consisting essentially of an elongated piece of flexible plastic tubular netting wherein the tubular netting is folded in half at a midpoint one or more instances and has (i) first and second end portions, each end portion being about 10-12" in length, and (ii) a knot section comprising at least first, second and third knots tied into and being part of the tubular netting, the first, second and third knots being generally evenly spaced between the end portions, and having a knot section length of about 8-10" with the first knot being adjacent the first end portion and the third knot being adjacent the second end portion;

while holding the first end portion in a first hand of a person, passing the second end portion between legs of the person; and moving the knot section back and forth in a crease of a buttock to clean the surfaces in the crease; and rinsing the personal hygiene device after said moving the knot section back and forth in a crease of the buttock.

2. The method of claim 1, further comprising applying soap to the personal hygiene device prior to said passing the second end between legs of the person.

3. The method of claim 1, further comprising hanging the personal hygiene device up on a shower stall or shower door wall after said rinsing.

4. The method of claim 1, wherein the flexible plastic tubular netting is made from filaments having diameters of about 0.004-0.016", and has an unstretched diameter of about 3 to 4 inches.

5. The method of claim 1, wherein the personal hygiene device further comprises a strap, the strap being secured to the first end portion and being configured for hanging the personal hygiene device from the strap for storage.

* * * * *